US007552496B2

(12) United States Patent
Oberli

(10) Patent No.: US 7,552,496 B2
(45) Date of Patent: Jun. 30, 2009

(54) BODY CARE BRUSH

(76) Inventor: Bruno Oberli, Eichfeldstrasse 1A, 3612 Steffisburg (CH)

( * ) Notice: Subject to any disclaimer, the term of this patent is extended or adjusted under 35 U.S.C. 154(b) by 232 days.

(21) Appl. No.: 11/579,878

(22) PCT Filed: May 10, 2005

(86) PCT No.: PCT/CH2005/000261

§ 371 (c)(1),
(2), (4) Date: Feb. 8, 2007

(87) PCT Pub. No.: WO2005/107545

PCT Pub. Date: Nov. 17, 2005

(65) Prior Publication Data

US 2008/0028550 A1 Feb. 7, 2008

(30) Foreign Application Priority Data

May 11, 2004 (CH) ..... 830/04

(51) Int. Cl.
*A47K 7/04* (2006.01)

(52) U.S. Cl. ..... 15/21.1; 4/606; 601/114

(58) Field of Classification Search ..... 15/21.1, 15/88.3, 88.4; 4/606; 601/114
See application file for complete search history.

(56) References Cited

U.S. PATENT DOCUMENTS

| | | | | |
|---|---|---|---|---|
| 4,712,265 | A | 12/1987 | Williams et al. | |
| 5,560,066 | A * | 10/1996 | McDivitt | 15/88.3 |
| 7,062,815 | B1 * | 6/2006 | Richardson | 15/21.1 |

FOREIGN PATENT DOCUMENTS

| | | | |
|---|---|---|---|
| CA | 2 207 693 | A1 | 12/1998 |
| DE | 23 36 455 | A1 | 2/1975 |
| DE | 28 43 683 | A1 | 4/1980 |
| DE | 195 16 467 | A1 | 11/1996 |
| EP | 1095609 | * | 5/2001 |
| GB | 2269096 | * | 2/1994 |
| WO | WO-03/017815 | A | 3/2003 |

* cited by examiner

*Primary Examiner*—Mark Spisich
(74) *Attorney, Agent, or Firm*—Birch, Stewart, Kolasch & Birch, LLP

(57) ABSTRACT

Disclosed is a body care brush comprising a brush holder (2-5) and a brush (1) that is rotatably mounted on said brush holder (2-5). The brush holder (2-5) is provided with a drive unit in which an electric motor (7) that is used for driving the brush (1) is mounted so as to be protected from the water. The brush (1) is hollow, is open at the bottom, and can be pulled over the drive unit so as to be driven by the electric motor (7) via an entraining element. The inventive body care brush provides relaxation and is comfortable and enjoyable to use, without going into contortions and applying any force.

10 Claims, 3 Drawing Sheets

BODY CARE BRUSH

BACKGROUND OF THE INVENTION

1. Field of the Invention

The invention relates to a body care brush with a brush holder and a brush which can be attached rotatably to the brush holder, the brush holder having a drive unit in which an electric motor for driving the brush is fitted in a manner protected against water.

2. Description of the Related Art

Well-cared for skin over the entire body provides a good sensation. An even better sensation is imparted by a light massage. A particular difficulty resides in taking care of ones own back. However, even a light massage to other body parts enhances the well-being. And for older and slightly disabled individuals, body care is basically generally difficult to undertake on their own.

Commercially available products, such as a conventional massage brush, contribute to taking care of the back and help give more independence. A number of implements are obtainable with different heads (sponge and brush), combined with lotion-application and washing caps, or with containers into which creams, shower gel and the like is filled and which dispense the creams when sliding over the skin and with which lotion can be applied to the back, and the back can be washed and massaged. With the conventional auxiliary means, care has to be undertaken manually, i.e. the brush has to be taken in the hand and sometimes a certain amount of contortion and application of force have to be accepted, which is often not possible in particular for older people to carry out. Orderly storage of the brushes within or outside the shower compartment sometimes proves awkward.

DE 195 16 467 A1 (Gerhardt Böhm) has already disclosed a body care device which is operated mechanically/electrically. However, it has a fairly complicated construction, is costly to fit and to operate and is ergonomic only to a limited extent.

SUMMARY OF THE INVENTION

It is therefore an object of the invention to provide a body care brush which is constructed in a simple manner and which can be fitted and operated in a simple manner.

According to one feature of the invention, the brush is hollow and is open at the bottom and can be pulled over the drive unit in such a manner that it is driven by the electric motor via an entraining element.

The body care brush has a correspondingly simple construction. Moreover, the brush can be removed and placed on again with one movement of the hand.

By means of a slight oblique position of approximately 5-10°, better account is taken of the anatomy of the back than with a vertically situated brush. In its simplicity as a whole, the invention provides great service to older and slightly disabled people and provides more comfortable, relaxing and enjoyable body care for everyone.

The body care brush is set into operation by applying pressure to the brush and is switched off again by reducing the pressure. The device can therefore be switched on and off in a simple manner by resting against the brush.

The brush holder preferably comprises a curved tube, a cylindrical console which is open at the top and is intended for a motor holder, a battery holder for accommodating batteries for feeding the electric motor, and a transition piece which can be adjusted in an infinitely variable manner along a sliding rail which can be fastened to a wall.

The switch for setting the electric motor for driving the brush into operation and switching it off can be fitted in the console.

In order for the body care brush which is driven by an electric motor to fulfill its task, it is fitted in the region of the shower or bath to the wall not far from the shower attachment and therefore can be used during the showering operation. The length and installation position of the sliding rail can be selected according to individual requirement. The body care brush according to the invention can basically be adjusted in height with one hand.

The height-adjustability makes it possible for this body care brush not to be intended exclusively for the back but can also be used for care of the hands, arms, shoulders, décolleté, the legs or other body parts. Various interchangeable brushes make it possible to individually select the strength of the brush, and thickness and number of bristles, and everybody can therefore use their preferred brush.

In addition to the simple operation, this body care brush can also be fitted in a simple manner. The sliding rail is attached at the top and bottom by an infinitely variably adjustable holder, for example by two suction cups, to a smooth surface, such as, for example, wall tiles, or is screwed to the wall by two screws. The infinitely variably adjustable holder makes it possible to attach the suction cups in the middle to the tiles or to neatly place the screws into the tile gaps. The attachment of the device by means of suction cups affords the great advantage that, for example in rented apartments, holes do not have to be drilled into the wall, that the entire unit can be removed for thorough cleaning of the shower/bath region and that, if the need arises, the brush can even be fitted in the vacations and afterwards can be removed again without any trace.

In addition, a manual on/off switch can be fitted which facilitates the exchanging and cleaning of the brush. For this purpose, the hollow brush which is open at the bottom is pulled over the drive unit and is connected thereto by an entraining element. With a simple movement of the hand, the brush is lifted out of the entraining element and can thus be easily removed again and exchanged.

By means of a special attachment, in the form of a suitable brush or a roller which is provided on its outer side with a suitable fabric ("painter's roller"), or by means of a cloth which can be pulled over the existing brush, the brush can be used not only with water and soap but, following the cleaning of the body, for the application of body lotion.

Further advantageous embodiments and combinations of features of the invention emerge from the detailed description below and the entirety of the. patent claims.

BRIEF DESCRIPTION OF THE DRAWINGS

In the drawings used for explaining the exemplary embodiment.

In principle, identical parts are provided with the same reference numbers in the figures.

DETAILED DESCRIPTION OF THE INVENTION

Figure 1A:
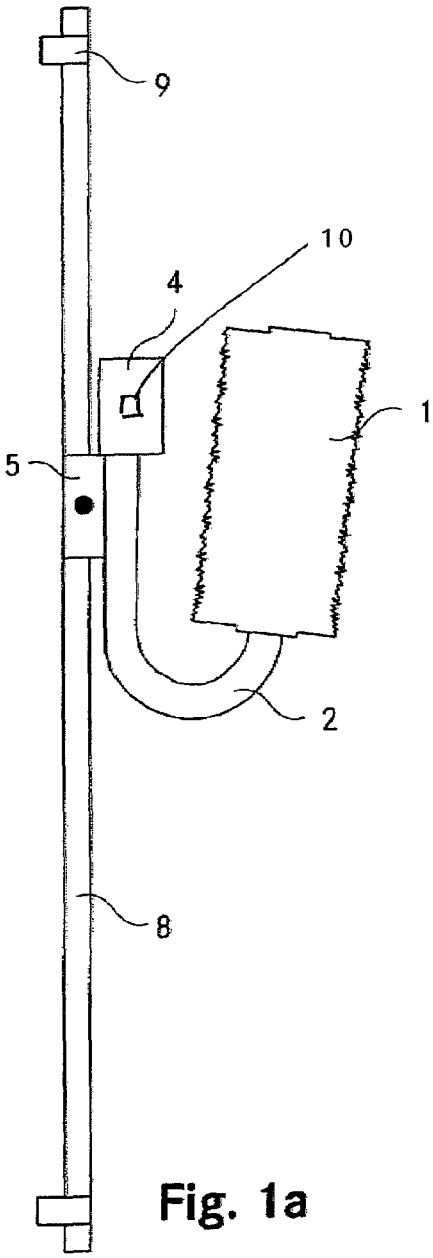
FIG. 1*a* shows the lateral view of the body care brush, complete with fastening device and brush holder.
Figure 1B:
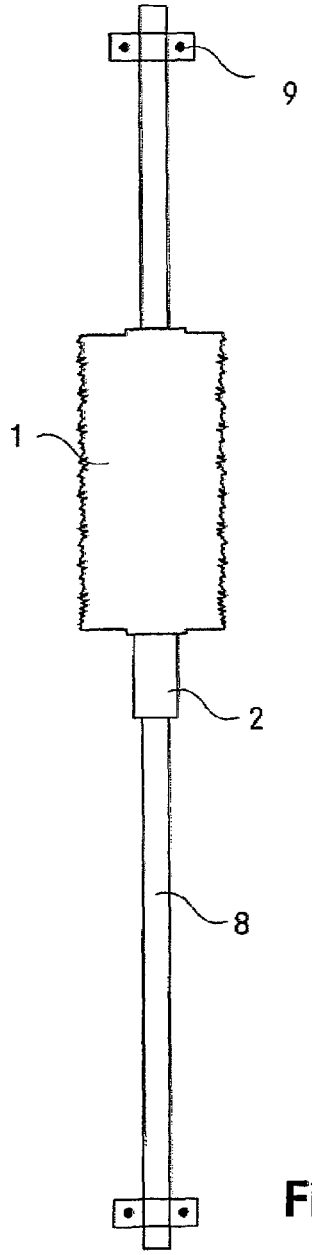
FIG. 1*b* shows the front view of the body care brush, complete with fastening device and brush holder.
Figure 2A:
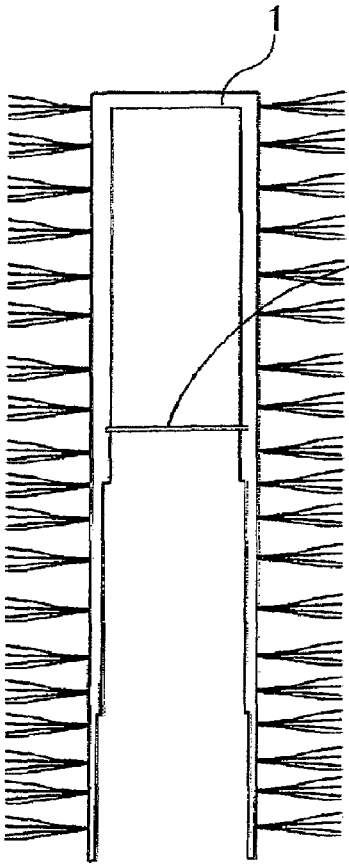
FIG. 2*a* shows a side outline of the brush.
Figure 2B:
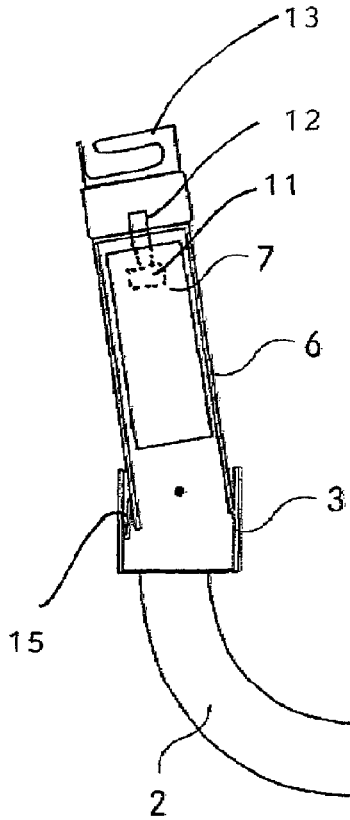
FIG. 2*b* shows a side outline of the console and of the curved tube, which are parts of the brush holder, and of the drive unit, including motor, gear, shaft and entraining element.
Figure 3:
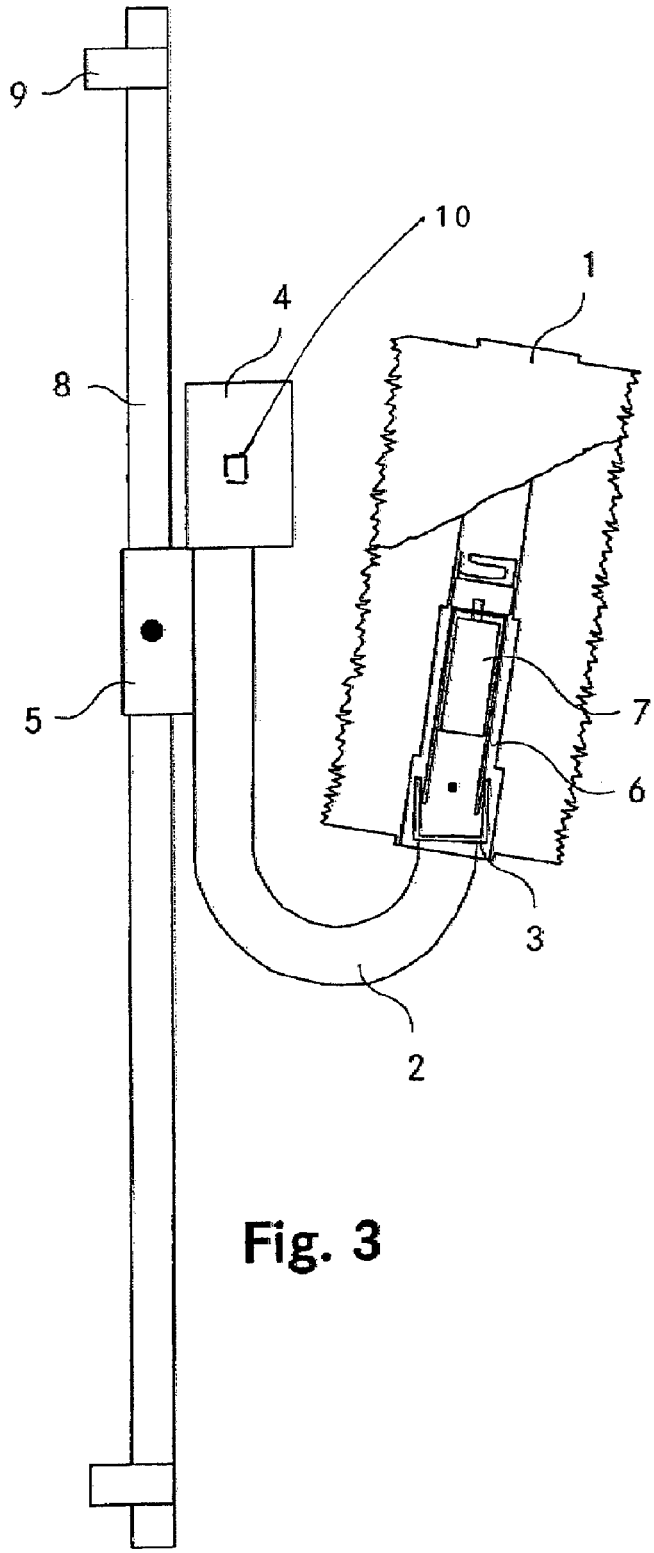
FIG. 3 shows the lateral view of the body care brush, complete with fastening device and brush holder and part of a side outline of the console and the motor holder.

A rotatable brush 1 is attached to a sliding rail 8 in a height-adjustable manner via a brush holder 2-5. The sliding rail 8 has to be constructed in a manner or has to be shaped such that the brush holder 2-5 does not rotate on the rail. The sliding rail 8 can be fastened to the wall in the shower or bath region, for example, by means of screws, by means of suction cups or by special adhesive material. In the exemplary embodiment, the tetragonal sliding rail 8 (square tube) of stainless steel is fastened to the wall by two screws via a respective infinitely variably adjustable holder 9 attached to the top and bottom of the sliding rail 8. The brush holder 2-5 of stainless steel is fastened to the sliding rail 8 by a transition piece 5 which can be adjusted in an infinitely variable manner in height and is pressed onto the sliding rail by means of a similar type of wing nut. The brush holder 2-5 comprises this transition piece 5, a battery holder 4, a curved tube 2 and a cylindrical console 3 which is open at the top and is intended for a motor holder 6, the actual holder for the brush being positioned obliquely at approximately 5-10° at the end of the console 3. The brush holder 2-5 therefore has the task of holding the brush unit on the sliding rail in a stable manner and of providing the base for the construction of the motor holder 6 and the brush 1 and the batteries.

The brush is driven by an electric motor 7. The electric motor 7, a gear 11 and a shaft 12 are fitted in the interior of the cylindrical motor holder 6 in a manner protected against water. The shaft 12 is connected to an entraining element 13 above the motor holder 6. The hollow brush 1 which is open at the bottom can be pulled over the drive unit and is connected to the entraining element 13 by means of a pin 14 integrated into the brush 1, so that the brush 1 receives the rotation of the motor 7 via the shaft 12 and the entraining element 13. In the exemplary embodiment, the motor 7 is fed with low-voltage current by four batteries. These batteries are situated in the battery holder 4 which is attached to the brush holder 2-5. In the exemplary embodiment, the batteries are inserted into four compartments which form a unit and which are attached to the cover of the battery holder 4 and can therefore be removed by simply lifting the cover from the battery holder 4 and can be charged by means of a charging appliance. Every second of the compartments is positioned in the opposite direction. The batteries can subsequently be placed again into the compartments and the entire unit can be inserted again into the battery holder. The cover guarantees a splash proof chamber. The wiring of the batteries to the motor 7 takes place within the brush-holder tube. Furthermore an on/off switch 10 is fitted on the battery holder 4 and is used to facilitate the changing and cleaning of the brush 1.

By resting against the brush 1, by means of a pressure contact which is situated within the console 3 fitted on the brush holder, the motor is set into operation and the entraining element and accordingly the brush are driven by the shaft. It would be advantageous if the motor 7 revolves at approx. 60 to 80 rpm. As soon as the pressure on the brush 1 is subsequently reduced, the motor 7 is switched off (by a switch 15) and consequently the brush 1 no longer rotates.

By means of the slight oblique position of the console 3, the entire brush 1 is positioned obliquely forward slightly and therefore obtains the suitable position taking the anatomy of the human body into consideration.

In order to apply care agents, such as, for example, a body lotion, a multiple use material covering matched to the size of the brush can be pulled over the brush 1.

The invention is not restricted to the exemplary embodiment illustrated. Individual aspects of the body care brush and its use may differ from the embodiment illustrated. For example, the brush holder and the brush can be fastened to the sliding rail in such a manner that the free end of the brush holder points downward (preferably obliquely). Instead of four battery cells, a different number of batteries may be used, for example just one. The shaping of the sliding rail or of the brush holder may be changed; for example, a different cross-sectional shape may be selected for the sliding rail.

It is to be stated in summary that the invention provides a body care brush which is of simple construction and which can be fitted and operated in a simple manner.

The invention claimed is:

1. A body care brush, comprising:

a brush holder; and a brush which can be attached rotatably to the brush holder, the brush holder having a drive unit in which an electric motor for driving the brush is fitted in a manner protected against water, wherein the brush is hollow and is open at the bottom and can be pulled over the drive unit in such a manner that it is driven by the electric motor via an entraining element, and wherein the brush holder comprises a curved tube, a console which is open at the top and is intended for a motor holder, a battery holder for accommodating batteries for feeding the electric motor, and a transition piece which can be adjusted in an infinitely variable manner along a sliding rail which can be fastened to a wall.

2. The body care brush as claimed in claim 1, wherein the brush has an oblique position when it is attached to the brush holder, preferably an oblique position of approximately 5-10°.

3. The body care brush as claimed in claim 1, wherein the brush can be set into operation and can be switched off again by applying pressure to the brush.

4. The body care brush as claimed in claim 1, wherein the console is cylindrical in shape.

5. The body care brush as claimed in claim 1, wherein a switch for setting the electric motor for driving the brush into operation and switching it off is fitted in the console.

6. The body care brush as claimed in claim 1, wherein an infinitely variably adjustable holder is attached at the top and bottom of the sliding rail and two suction cups for the fastening of the sliding rail are fitted thereon.

7. The body care brush as claimed in claim 1, wherein the sliding rail, the brush holder, and the motor holder are produced from stainless steel.

8. The body care brush as claimed in claim 1, wherein an on/off switch for manually switching the brush on or off is fitted on the battery holder.

9. The body care brush as claimed in claim 1, wherein the electric motor, a gear and a shaft are arranged in the motor holder, and in that the shaft is connected above the motor holder to an entraining element to which a pin integrated in the brush can be connected, so that the brush receives the rotation of the electric motor via the shaft and the entraining element.

10. The body care brush as claimed in claim 1, wherein a multiple use material covering matched to the size of the brush can be pulled over the brush.

* * * * *